US005933872A

United States Patent [19]

Lema

[11] Patent Number: 5,933,872

[45] Date of Patent: Aug. 10, 1999

[54] PONY TAIL CAP

[76] Inventor: Greg Lema, 4022 Glendale Ct., Merced, Calif. 95348

[21] Appl. No.: 08/968,711

[22] Filed: Nov. 13, 1997

[51] Int. Cl.[6] ..... A42B 1/04

[52] U.S. Cl. ..... 2/209.7; 2/209.3

[58] Field of Search ..... 2/209.7, 209.3, 2/195.1

[56] References Cited

U.S. PATENT DOCUMENTS

| | | | |
|---|---|---|---|
| 54,049 | 4/1866 | White | 2/209.7 |
| D. 350,427 | 9/1994 | Vig et al. | 2/209.7 |
| 5,509,145 | 4/1996 | Stevenson et al. | 2/209.7 |
| 5,511,249 | 4/1996 | Higgins | 2/209.7 |
| 5,644,799 | 7/1997 | Armenta et al. | 2/209.3 |
| 5,694,647 | 12/1997 | Crickmore | 2/183 |

*Primary Examiner*—Diana L. Biefeld
*Attorney, Agent, or Firm*—Claude A.S. Hamrick; Oppenheimer W. Donnelly

[57] ABSTRACT

A head cap having a substantially hemi-spherically shaped portion intended to be worn over hair on the head of a wearer and including at least one opening therein large enough to accommodate a bundle of hair passing through the opening and means for securing the cap to the bundle of hair. A gathering mechanism is attached to the cap body around the perimeter of the opening to compressively engage the bundle of hair and hold the bundle of hair and the cap body in a fixed relationship. The gathering mechanism includes a sleeve attached to the cap body along the perimeter of the opening and a drawstring passed through the interior of the sleeve. The drawstring may be drawn to gather the sleeve to compressively engage the bundle of hair. A clamp is provided for holding the drawstring in a drawn disposition to hold the sleeve gathered about the bundle of hair.

10 Claims, 1 Drawing Sheet

PONY TAIL CAP

BACKGROUND OF THE INVENTION

1. Field of the Invention

The present invention relates generally to a headdress for wearing on the head of a person. Specifically, the present invention relates to a cap including a cap body which has an opening for passing a bundle of hair wherein the cap body also includes a gathering mechanism for holding the bundle of hair and the cap body in a fixed relationship.

2. Description of the Prior Art

Head caps, often called "sport caps", are a common headdress for being worn over the head of a person. Such caps typically include a hemi-spherically shaped cap body and a bill protruding from a bottom front portion of the cap body. Head caps are commonly worn by wearers while the wearers engage in physical activity. The bill of the head cap provides a functional advantage of shading the eyes of the wearer from the sun. However, the bill also may catch wind generated by the wearer as the wearer moves forward tending to force the head cap from the wearers head. For this reason, head caps are often worn tightly on the head of the wearer.

It is common for a wearer of a sports cap to bundle his/her hair into one of more "pony tails" when wearing a sports cap if the wearer has long hair. The pony tail hair style enables the wearer to pull a portion of his hair, proximal to his scalp, tightly over his head while allowing a distal portion of his hair, bundled in a pony tail, to extend out from the cap body.

U.S. Pat. No. 5,511,249 discloses a head cap including a cap body having an opening on an upper central crown portion of the cap body which is in a general registry of the crown of the wearers head when the cap is worn. The opening is large enough to extend a bundle of hair, such as in a "pony tail" style, through the opening. The cap body provides support for the crown portion of the cap, adjacent the opening, and provides lateral support for the hair of the wearer. U.S. Pat. No. 5,511,249 further discloses a head cap having more than one opening in a cap body. Openings are provided in the cap body in positions oppositely spaced with respect to a front to back median of the cap body. This permits a wearer having a dual pony tail hair style to extend the dual pony tails through the openings.

U.S. Pat. No. 5,511,249 describes an optimal location for an opening in a cap body which creates a relationship between the cap body and the hair of the wearer so that the cap body may be held in place as the wearer moves into the wind. The location of the opening is particularly noted in U.S. Pat. No. 5,511,249. However, the relationship created between the cap body and the hair of the wearer, as described in U.S. Pat. No. 5,511,249, is not very secure.

The prior art has also known and used caps having cap bodies, formed into a hemi-spherical shape, which include an arc shaped cutout in the rear bottom of the cap body. This cutout is typically used with an elastic strap or adjustable clasp mechanism to tighten the cap body around the head of the wearer. Further, the prior art has known and used caps having a hair elastic, or hair "scruncher", attached above the cutout in the cap body. In such cap designs, the hair elastic, or hair scruncher, is attached to the cap body at a point location, and serves primarily as an ornament. The scruncher is not secured to the cap body so as to hold the cap in place with respect to the bundle of hair of the wearer.

It is an object of the present invention to provide a head cap which allows for extending a bundle of hair through a body of the cap. It is a further object of the present invention to provide a head cap which allows for securing the bundle of hair extending through the body of the cap so that the bundle of hair and the cap are held securely in a fixed relationship which is resistant to wind forces.

SUMMARY OF THE INVENTION

The present invention provides a head cap for wearing over hair on the head of a wearer. The cap includes means for securing a bundle of hair extending through a cap body of the cap so that the bundle of hair and the cap body are held securely in a fixed relationship which is resistant to wind forces.

A cap according to principles of the present invention includes a cap body having a substantially hemi-spherical shape. The cap body includes at least one opening having a continuous perimeter. The opening is large enough to accommodate a bundle of hair passing through the opening. A gathering mechanism is attached to the cap body around the perimeter of the opening in the cap body.

The gathering mechanism provides for compressively engaging the bundle of hair and holding the bundle of hair and the cap body in a fixed relationship. The gathering mechanism includes a sleeve having a length approximately equal to the length of the perimeter of the opening in the cap body. The sleeve includes an outer wall which is attached to the cap body along the perimeter of the opening in the cap body. In a preferred embodiment, a drawstring passes through the interior of the sleeve. The drawstring may be drawn to gather the sleeve to compressively engage the sleeve over the bundle of hair. A clamp provides for holding the drawstring in a drawn disposition to hold the sleeve gathered about the bundle of hair. Accordingly, the gathering mechanism provides a secure fixed relationship between the cap and the bundle of hair on the head of the wearer as the wearer engages in sports activities. This secure relationship provides a resistance to wind force placed upon a bill of the cap wherein the wind force tends to force the cap in a direction off of the head of the wearer.

In an alternative embodiment of the present invention, the cap body includes two openings oppositely spaced with respect to a front to back median of the cap body wherein a bundle of hair extends through each opening. This embodiment allows for a dual pony tail, or "puppy dog ears", hair style. In this embodiment, two gathering mechanisms provide a secure fixed relationship between the cap and the bundle of hair on the head of the wearer.

IN THE DRAWINGS

DETAILED DESCRIPTION OF THE PREFERRED EMBODIMENTS

Figure 1:
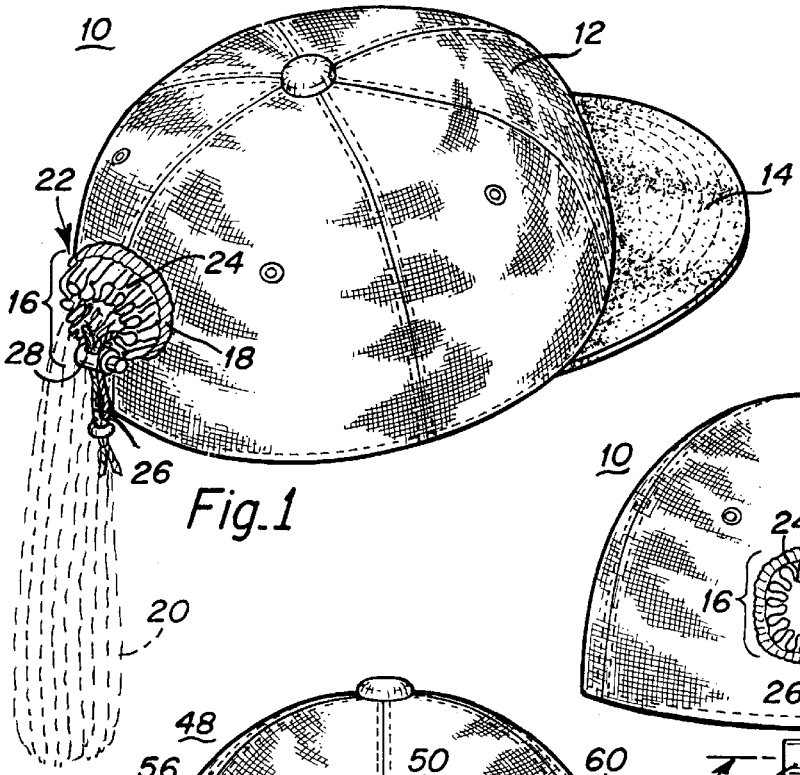
FIG. 1 is a perspective view of a cap having an opening in a crown portion of a body of the cap wherein a bundle of hair may be extended through the opening as depicted and wherein a gathering mechanism is attached to the cap body along a perimeter of the opening, and may be compressively engaged about the bundle of hair.

FIG. 1 shows a perspective view of a cap 10 according to an embodiment of the present invention. Cap 10 includes a cap body 12 which is substantially hemispherical in shape. Cap 10 also includes a bill 14. Caps having the general shape depicted are commonly referred to as sport caps and may be worn by a wearer while the wearer engages in physical activity. Bill 14 of cap 10 provides a functional advantage of shading the eyes of the wearer from the sun. However, bill 14 may be subjected to a wind force generated as the wearer moves forward tending to lift the cap from the wearers head. Cap 10 includes means according to principles of the present invention for securing it to the head of the wearer while such wind force is exerted on cap 10.

Cap body 12 includes an opening 16 having a continuous perimeter 18. Opening 16 is positioned at a point below and behind a crown point 19 of cap body 12, the crown point 19 being in a general proximity of the crown of the head of a person when the cap 10 is worn. Opening 16 is large enough to accommodate a bundle 20 of hair passing through opening 16. A gathering mechanism 22 is attached to cap body 12 around perimeter 18 of opening 16. Gathering mechanism 22 is adapted to compressively engage the hair and hold it and cap body 12 in a fixed relationship.

Gathering mechanism 22 includes a sleeve 24 having a length approximately equal to the length of perimeter 18 of opening 16. Sleeve 24 includes an outer perimeter which is attached to cap body 12 along the edge of opening 16. A drawstring 26 passes through the interior of sleeve 24 and may be drawn to gather sleeve 24 about the bundle of hair. A clamp 28 is provided to engage to hold drawstring 26 in a drawn disposition to hold sleeve 24 gathered about the bundle of hair. In an alternative embodiment, an elastic passes through the interior of sleeve 24 to hold sleeve 24 gathered about the bundle of hair.

Cap 10 provides an advantage over prior art sports caps because gathering mechanism 22 holds cap 10 securely to hair bundle 20 and on the head of the wearer as the wearer engages in sports activities. While the wearer of cap 10 is engaged in sports activities, bill 14 may be subjected to wind forces which would tend to lift the cap off of the head of the wearer. Gathering mechanism 22 provides a resistance means for resisting the wind forces exerted upon bill 14 so as to hold the cap on the head of the wearer.

Figure 2:
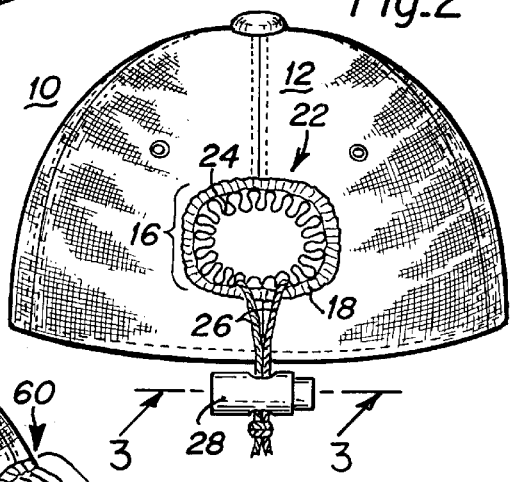
FIG. 2 is a rear view of the cap of FIG. 1 further illustrating details of the opening in the crown portion of the cap and the gathering mechanism attached to the cap body along the perimeter of the opening.

FIG. 2 shows a rear view of cap 10 of FIG. 1. Gathering mechanism 22 is shown in an ungathered state with drawstring 26 undrawn. While gathering mechanism 22 is in the ungathered state, the inner diameter of sleeve 24 is maximal. With gathering mechanism 22 in the ungathered state, a wearer may extend a bundle 20 of hair (FIG. 1) through hole 16 (FIG. 2).

Figure 3:
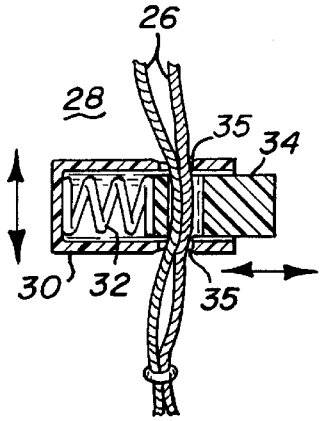
FIG. 3 is top view of an exemplary drawstring clamp for use with the gathering mechanisms of FIGS. 1 and 2.

FIG. 3 shows an axial cross section of an exemplary drawstring clamp 28 for use with gathering mechanism 22. Clamp 28 includes an outer cylinder 30 which is open at least one end. A spring 32 fits within a portion of cylinder 30. An inner cylinder 34 fits within outer cylinder 30. Each of outer cylinder 30 and inner cylinder 34 includes a transverse opening 35 forming a passage way when aligned through which drawstring 26 is extended. This is to say that opening 35 in cylinder walls of outer cylinder 30 and the opening in inner cylinder 34 line up while outer cylinder 30 and inner cylinder 34 are positioned in a draw string release relationship. Spring 32 forces outer cylinder 30 and inner cylinder 34 out of the draw string release relationship and into an engaging relationship to thereby hold drawstring 26 in its drawn position.

Figure 4:
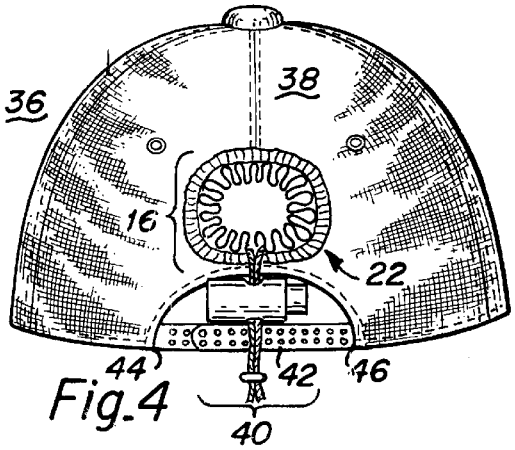
FIG. 4 is a rear view of a cap having an opening in the crown portion of the cap body, the opening being positioned above a cutout and adjustable clasp in the lower rear portion of the cap body.

FIG. 4 shows a rear view of an alternative type of cap 36 having a drawstring assembly according to the present invention. Cap 36 includes a cap body 38 which is substantially hemi-spherical in shape and includes opening 16 and gathering mechanism 22. Cap body 38 further includes a cutout 40, which has an arcuate shape, and a cutout spanning two part band 42 for drawing base points 44 and 46 of cap body 38 toward each other to reduce the diameter of the cap body. Base points 44 and 46 lie at bottom points of the arc of cutout 40. In the illustrated embodiment, band 42 includes a pair of straps respectively attached to the cap body at each of base points 44 and 46. One of the straps includes a plurality of apertures and the other includes a plurality of aperture engaging protuberances for adjustably coupling the straps.

Figure 5:
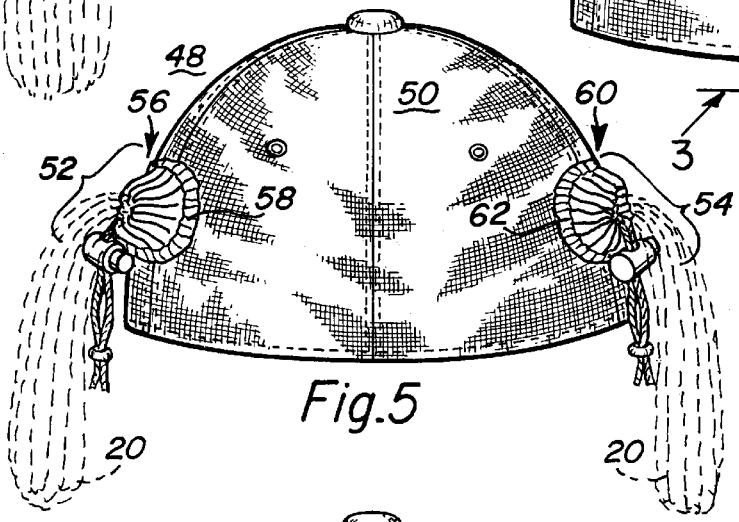
FIG. 5 is a rear view of a cap having a pair of openings in the cap body wherein the openings are oppositely spaced with respect to a front to back median of the cap body to receive a bundle of hair extending through each opening; a gathering mechanism being attached to the cap body along the perimeter of each opening in accordance with the present invention.

FIG. 5 shows a rear view of a cap 48 including a cap body 50 having a first opening 52 and a second opening 54. Opening 52 is oppositely spaced from opening 54 with respect to a front to back median 55 of cap body 50. In a manner similar to the previously described embodiments, gathering mechanism 56 is attached around the perimeter 58 of opening 52. A second gathering mechanism 60 is attached around a perimeter 62 of second opening 54.

Each of gathering mechanisms 56 and 60 is adapted to compressively engage a bundle 20 of hair to hold the hair and cap body 50 in a fixed relationship. The gathering mechanisms 56 and 60 may be identical to gathering mechanism 22 (FIG. 1). The openings and gathering mechanisms 56 and 60 in this embodiment allow a wearer to have a dual pony tail, or "puppy dog ears", hair style. As in previously described embodiments, gathering mechanisms 56 and 60 provide a secure fixed relationship between the cap and hair on the head of the wearer.

Although the present invention has been described above in terms of a specific embodiment, it is anticipated that alterations and modifications thereof will no doubt become apparent to those skilled in the art. It is therefore intended that the following claims be interpreted as covering all such alterations and modifications as fall within the true spirit and scope of the invention.

What I claim is:

1. A cap intended to be worn over hair on the head of a person, comprising;

a cap body having a substantially hemi-spherical shape;

said cap body including at least one opening therein having a continuous perimeter, said opening being large enough to accommodate a bundle of hair passing through said opening, said opening being positioned at a point below and behind a crown point of said cap body, said crown point being in a general proximity of the crown of the head of a person when the cap is worn;

a gathering mechanism attached to said cap body around said perimeter for compressively engaging a bundle of hair and holding said cap body in a fixed relationship thereto; and wherein said gathering mechanism includes, a sleeve having a length approximately equal to the length of said perimeter, said sleeve being attached to said cap body around said perimeter, a drawstring passing through said sleeve for gathering said sleeve and compressively engaging said sleeve over a bundle of hair extended there through, and a clamp for holding said drawstring in a drawn disposition to hold said sleeve gathered about a bundle of hair.

2. A cap as recited in claim 1 wherein said cap body includes two of said openings oppositely spaced with respect to a front to back median of said cap body wherein each of said openings includes a gathering mechanism.

3. A cap as recited in claim 1 and further including:

an arc shaped cutout in said cap body; and an adjustable band for drawing base points of said arc shaped cutout toward each other to reduce the diameter of said cap body.

4. A cap as recited in claim 3 wherein said band includes a pair of straps and means for adjustably coupling said straps.

5. A cap as recited in claim 3 wherein said clamp includes;

a hollow outer cylinder including an open end;

a spring disposed within the hollow portion of said outer cylinder;

an inner cylinder which is axially aligned with said outer cylinder and fits within said open end wherein said outer cylinder and said inner cylinder include transversely extending openings which are aligned when said inner cylinder is moved into a first axial disposition relative to said outer cylinder and through which said drawstring may be extended and wherein under influence of said spring, said inner cylinder is biased away from said first axial disposition and clampingly engages said drawstring.

6. A cap intended to be worn over hair on the head of a person, comprising;

a cap body having a substantially hemi-spherical shape;

said cap body including two openings therein each having a continuous perimeter, wherein each of said openings is large enough to accommodate a bundle of hair passing through said openings, and wherein said openings are oppositely spaced with respect to a front to back median of said cap body;

a gathering mechanism attached to said cap body around each of said perimeters for compressively engaging bundles of hair and holding said cap body in a fixed relationship thereto; and wherein each of said gathering mechanisms includes, a sleeve having a length approximately equal to the length of one of said perimeters, said sleeve being attached to said cap body around said one of said perimeters, a drawstring passing through said sleeve for gathering said sleeve and compressively engaging said sleeve over a bundle of hair extended therethrough, and a clamp for holding said drawstring in a drawn disposition to hold said sleeve gathered about a bundle of hair.

7. A cap as recited in claim 6 further including:

an arc shaped cutout in said cap body; and an adjustable band for drawing base points of said arc shaped cutout toward each other to reduce the diameter of said cap body.

8. A cap as recited in claim 7 wherein said band includes a pair of straps and means for adjustably coupling said straps.

9. A cap as recited in claim 7 wherein said clamp includes;

a hollow outer cylinder including an open end;

a spring disposed within the hollow portion of said outer cylinder;

an inner cylinder which is axially aligned with said outer cylinder and fits within said open end wherein said outer cylinder and said inner cylinder include transversely extending openings which are aligned when said inner cylinder is moved into a first axial disposition relative to said outer cylinder and through which said drawstring may be extended and wherein under influence of said spring, said inner cylinder is biased away from said first axial disposition and clampingly engages said drawstring.

10. A cap intended to be worn over hair on the head of a person, comprising;

a cap body having a substantially hemi-spherical shape;

said cap body including at least one opening therein having a continuous perimeter, said opening being large enough to accommodate a bundle of hair passing through said opening;

a gathering mechanism attached to said cap body around said perimeter for compressively engaging a bundle of hair and holding said cap body in a fixed relationship thereto; and wherein said gathering mechanism includes, a sleeve having a length approximately equal to the length of said perimeter, said sleeve being attached to said cap body around said perimeter, and an elastic passing through said sleeve for gathering said sleeve and compressively engaging said sleeve over a bundle of hair extended there through.

* * * * *